United States Patent [19]

Dragunas

[11] Patent Number: 4,463,538

[45] Date of Patent: Aug. 7, 1984

[54] REINFORCING NETWORK FOR CONCRETE STRUCTURE

[76] Inventor: Alfred R. Dragunas, 8 Hazel Rd., Port Washington, N.Y. 11050

[21] Appl. No.: 341,493

[22] Filed: Jan. 21, 1982

[51] Int. Cl.[3] ..... E04C 5/16; E04B 1/40

[52] U.S. Cl. ..... 52/677; 52/687

[58] Field of Search ..... 52/677, 687

[56] References Cited

U.S. PATENT DOCUMENTS

| | | | |
|---|---|---|---|
| 1,788,180 | 1/1931 | White | 52/677 |
| 3,114,221 | 12/1963 | Eriksson | 52/677 X |
| 3,512,330 | 5/1970 | Shlesinger | 52/677 |
| 3,693,311 | 9/1972 | Bjerking | 52/677 |
| 3,788,025 | 1/1974 | Holmes | 52/687 X |

FOREIGN PATENT DOCUMENTS

| | | | |
|---|---|---|---|
| 634364 | 11/1963 | Belgium | 52/677 |
| 881169 | 11/1961 | United Kingdom | 52/677 |
| 2077319 | 12/1981 | United Kingdom | 52/677 |
| 771274 | 10/1980 | U.S.S.R. | 52/687 |

*Primary Examiner*—J. Karl Bell

*Attorney, Agent, or Firm*—Kane, Dalsimer, Kane, Sullivan and Kurucz

[57] ABSTRACT

A complex concrete reinforcing network is provided with longitudinal reinforcing bars and interconnected stirrups each having a plurality of clips in a specific geometric arrangement acting as a jig and said reinforcing network is embedded in concrete forming a completed concrete structure. The clips are mounted on the associated stirrups so as to be longitudinally and rotationally movable thereon for proper location on the stirrup and for effective coupling with a longitudinal reinforcing bar. The clips are formed with a base having an inwardly extending concavity therein and a pair of divergent spring arms that terminate in a free end. Each free end is curved inwardly towards the other leg and then back towards the base to provide an access opening for insertion of the associated longitudinal reinforcing bar. The edge of the free end of each arm engages the longitudinal reinforcing bar in the clip to retain the bar in its predetermined position on the reinforcing network. Each arm is provided with a hole through which extends the stirrup which is simultaneously engaged by the edges of the holes and the concavity of the base to releasably fix the location of the clips on the stirrup.

5 Claims, 6 Drawing Figures

REINFORCING NETWORK FOR CONCRETE STRUCTURE

BACKGROUND OF THE INVENTION

The present invention relates generally to the field of reinforced concrete construction and in particular to reinforcing networks for concrete columns, beams, chimneys and the like structures.

Reinforced concrete construction techniques involve the strengthening of poured concrete structures by arranging reinforcing materials, usually a reinforcing frame of steel bars, within a form and causing concrete in the plastic state to solidify about the reinforcing materials. Reinforced concrete structures are much stronger and offer greater design latitude than those formed by other construction techniques. Consequently, reinforced concrete construction is suitable for columns, beams, chimneys and the like structures. In addition to longitudinally extending reinforcing bars for such structures the reinforcing network normally included helically wound wire or stirrups and tie wires for connecting them together. The function of the stirrups and tie wires was to hold the reinforcing members in a specific, geometrical relation to one another. This facilitates complex reinforcing frame constructions to produce one piece reinforced concrete structures with complex and relatively elongated shapes.

Many of the prior art devices for constructing reinforcing frames have limited application in complex structures requiring connection and support in several nonparallel planes and involving deformed reinforcing bars because they do not make quick, secure connections. Another problem ensued with columnar structures such as chimneys at large heights and the effectiveness of labor and manual dexterity at such heights. Another drawback of prior art devices is the fact that nominal movement may easily upset the alignment of an entire frame requiring adjustment before pouring concrete around it or resulting in a defective structure.

Another problem associated with such prior art devices is bleeding, that is, rust discoloration of a finished concrete surface caused by oxidation of the support device portions that rest against the form and ultimately at or near the finished surface of a concrete structure.

SUMMARY OF THE INVENTION

It is an object of this invention to obviate the above recited problems as well as others by providing a reinforcing network for elongated concrete structures.

It is another object of the present invention to provide a novel clip which will reliably couple and hold elongated reinforcing bars to stirrups at a predetermined distance from each other.

It is another object of the present invention to provide a clip of the forgoing type that is readily adaptable to mechanical connection to a stirrup.

It is a further object of the present invention to provide a reinforcing network of the foregoing type that will not cause discoloration of finished concrete surfaces.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

BRIEF DESCRIPTION OF THE DRAWINGS

Referring to the accompanying drawings wherein is shown several, but obviously not necessarily the only, forms of embodiment of the invention.

DETAILED DESCRIPTION OF THE PREFERRED EMBODIMENT

Figure 1:
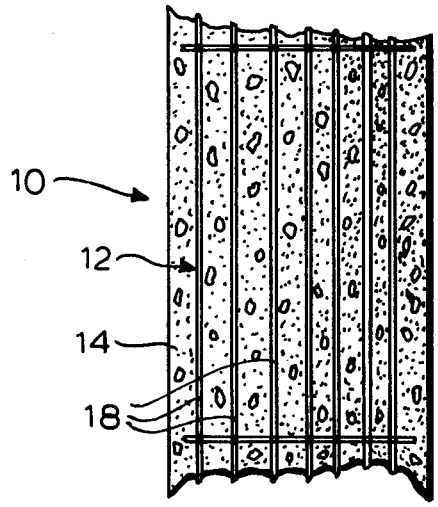
FIG. 1 is an elevational view of a reinforcing network in an elongated structure constructed in accordance with the present invention.
Figure 6:
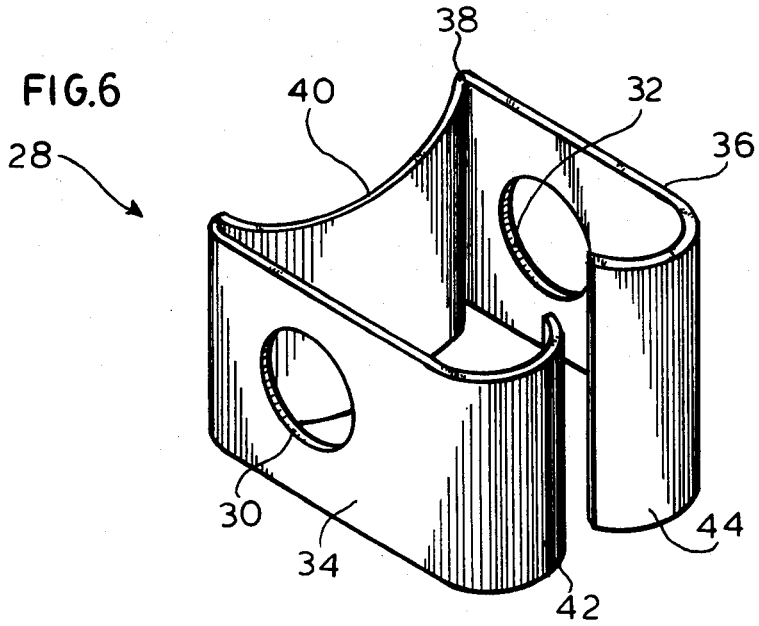
FIG. 6 is an enlarged perspective view of a clip embodying the teachings of this invention.

Referring specifically to FIG. 1, an elongated reinforced concrete structure 10 constructed in accordance with the present invention is illustrated in which a steel reinforcing network 12 is embedded in concrete 14. It is the overall structural strength derived from the reinforcing network 12 that permits construction of such large and oftentimes movable masses.

Reinforcing frame 12 usually arranged and disposed on preselected formwork 16 comprises a plurality of conventional steel reinforcing bars 18 normally extending for substantially the length of the structure 10. Stirrups 20 corresponding in shape to the desired cross-section of the structure 10 operate as jigs fixing the location of the bars 18 relative to one another and within the formwork 16, particularly while concrete is being poured, set and cured.

Figure 2:
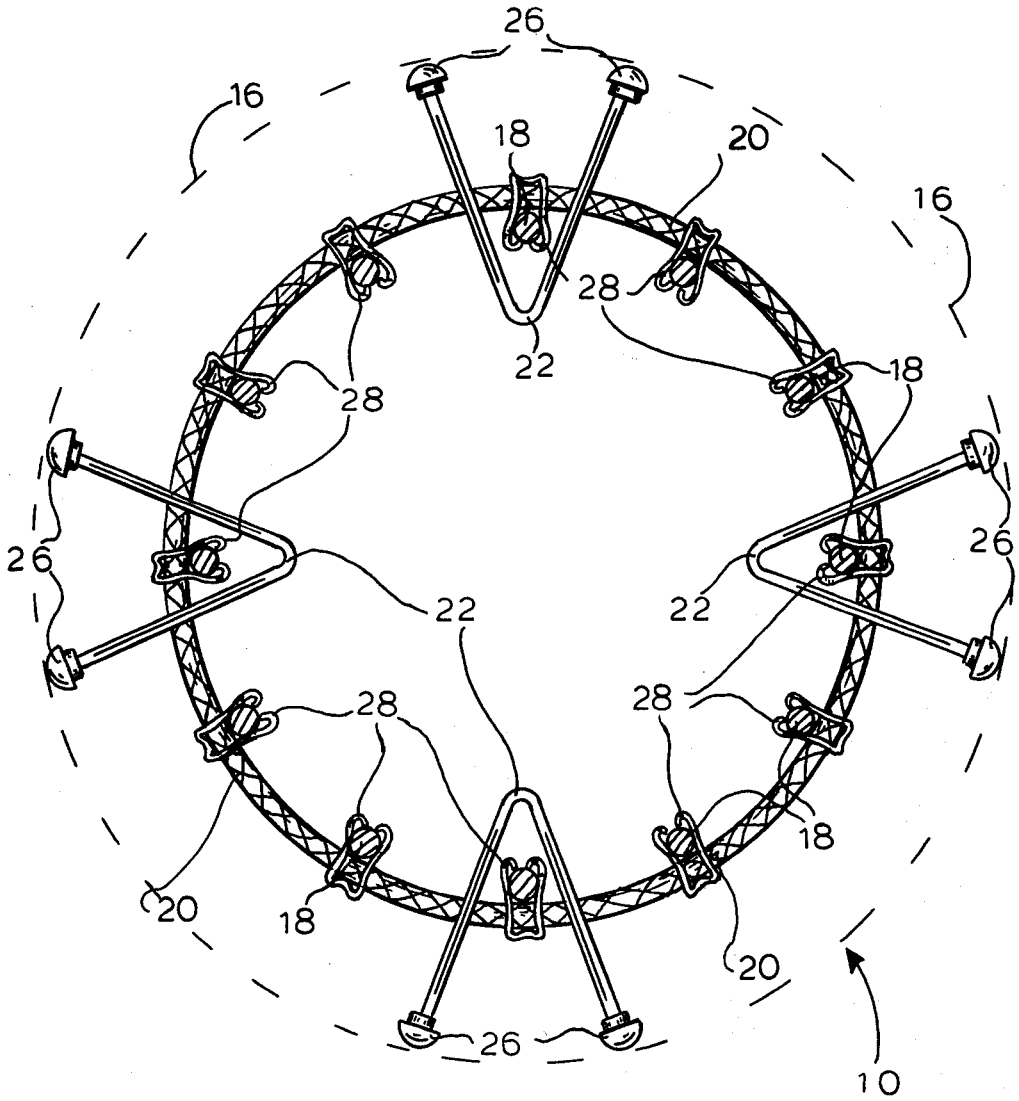
FIG. 2 is a top plan view of a reinforcing stirrup and elongated bars clipped thereto.

The stirrup 20 as shown in FIG. 2 is exemplary and may assume any configuration both opened and closed. The stirrup 20 is preferably formed from reinforcing bar stock having ribs and deformations in a pattern identifying its source of manufacture. A plurality of V-shaped spacer leg members 22 are fastened to the stirrup 20 at selected positions preferably by welds 24. Of course, the leg members may assume any other shape that will achieve the desired spacing from and centering in formwork 16. Leg members 22 protrude radially outwardly beyond the periphery of the stirrup 20 and the outermost ends of the leg members 22 may be provided with non-rusting caps 26 that may rest on the concrete formwork 26. This prevents bleeding, i.e. rust discoloration of the finished concrete surfaces, by insuring that all rusting portions of the reinforcing frame are deeply embedded in concrete.

The clips 28 advantageously connect the longitudinal reinforcing bars 18 to stirrup 20 and assume their proper location within the formwork 16. The clips 28 are formed from a flat piece of spring steel bent into the shape illustrated and are of suitable dimensions to receive and retain reinforcing bars 18. At the same time, the clips 28 are shiftably anchored at the preselected location to the stirrup 20 which extends through opposed aligned holes 30, 32. In this connection, the selected number of clips 28 are mounted in the stirrup prior to butt welding the stump ends. The holes 30–32 are formed in arms 34–36 which extend in a divergent manner from base 38 having an inwardly bent concavity 40. The free ends 42–44 of arms 34–36 are bent inwardly towards one another to provide an opening 46 through which reinforcing bars 18 are adapted to pass. Towards this end, the bar 18 will force the ends 42–44 outwardly against the bias of spring arms 34–36 and will be eventually disposed within the clip 28 and be anchored therein with the edges of ends 42–44 biting into the bar.

Figure 3:
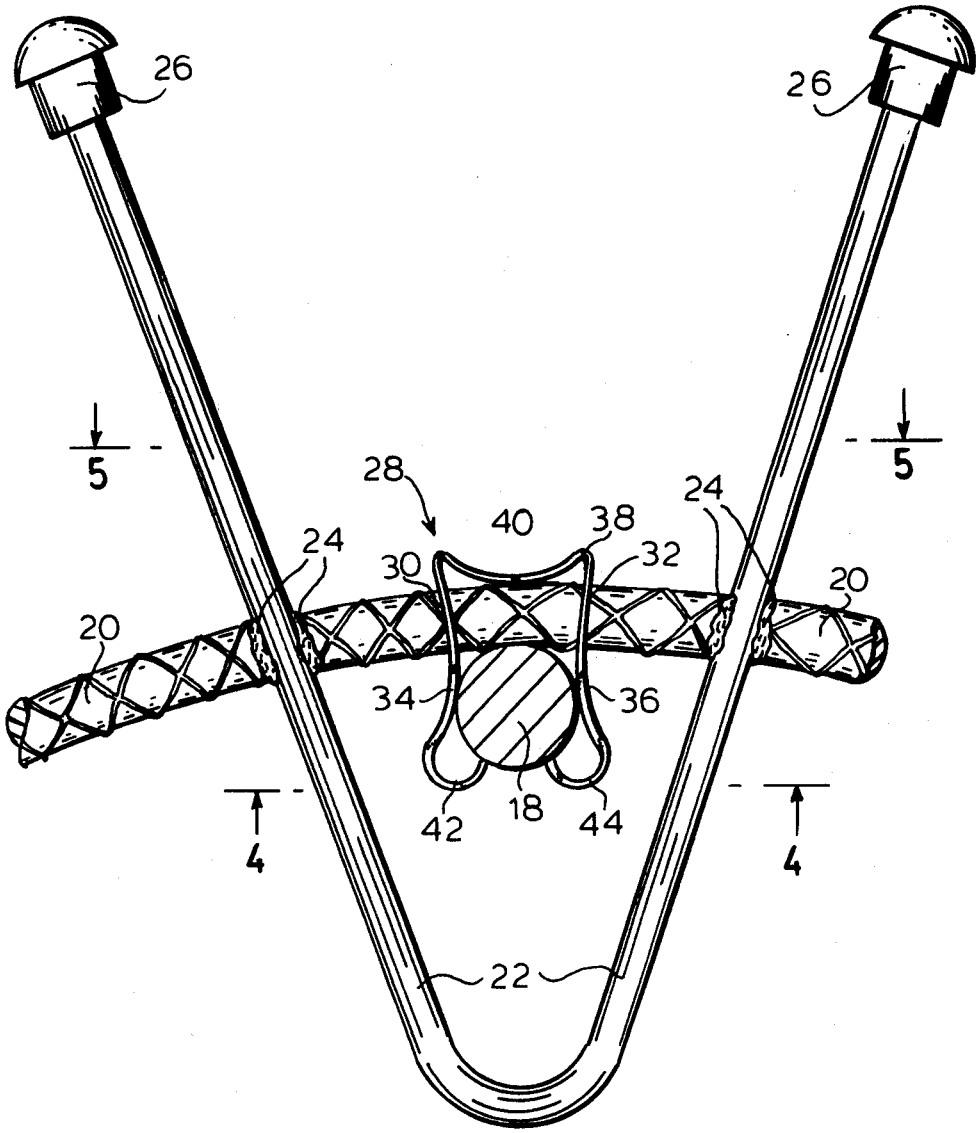
FIG. 3 is an enlarged fragmentary view of the reinforcing network shown in FIG. 1.
Figure 4:
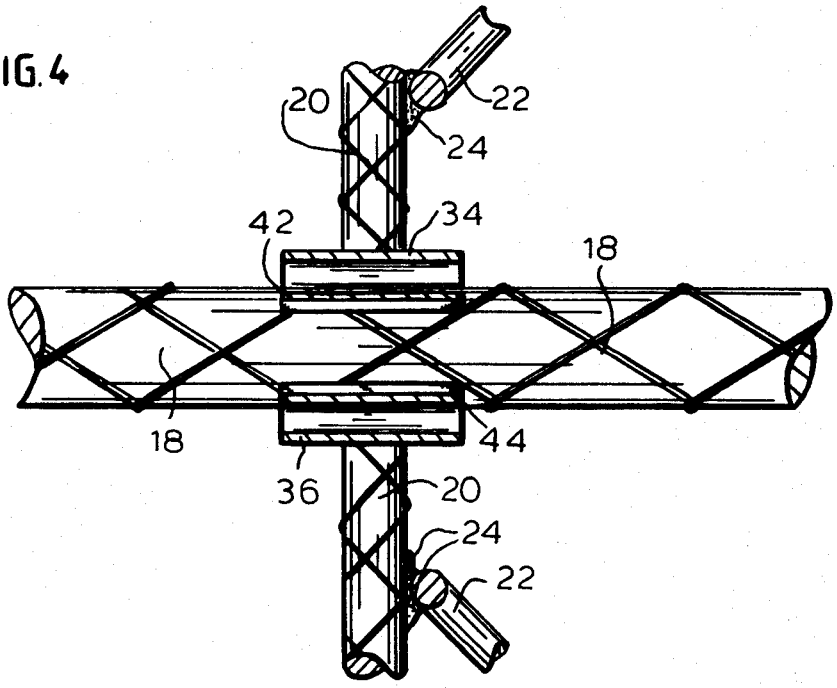
FIG. 4 is a cross-sectional fragmentary view along line 4—4 in FIG. 3.
Figure 5:
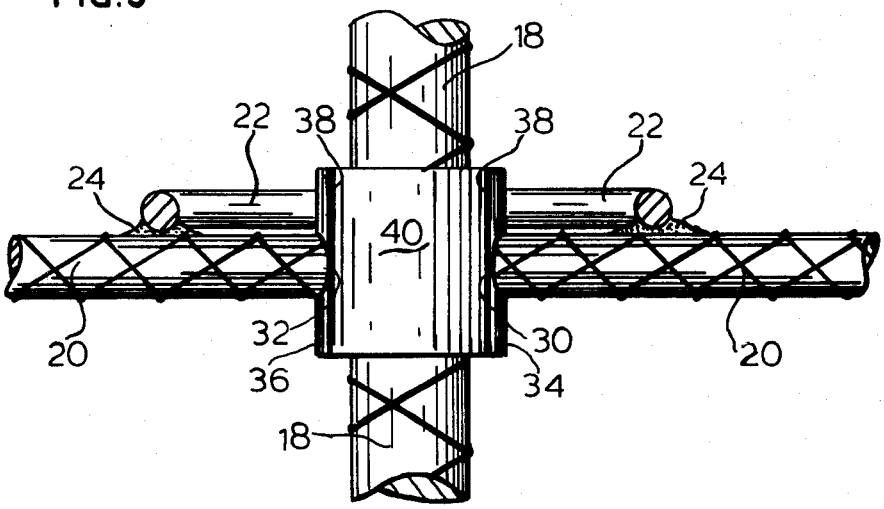
FIG. 5 is a cross-sectional fragmentary view along line 5—5 in FIG. 3.

Referring to FIG. 3, it should be noted that each clip 28 engages the stirrup 20 at three locations, namely, concavity 40, the edges of holes 30–32 which are slightly larger than the largest cross-sectional dimension of the stirrup 20. The holes 30–32 may be circular, tear drop or triangular in shape. The hole edges engage the stirrup with the deformation between the ribs appearing on the outer stirrup surface which together with the concavity 40 engagement, anchors each clip 28 in place on the stirrup 20. It has been discovered that this three point engagement is necessary, because engagement by the edges of holes 30–32 may not be secure enough because of the smaller diameter of the reinforcing bar from which the stirrups 20 are formed. In properly locating each clip 28 on the stirrup 20, the clip arms 34–36 need only be squeezed towards one another to facilitate sliding and shifting of the clip to this location. Releasing the arms 34–36 will cause the edges of holes 30–32 to bite into the stirrup 20 between the ribs. Another advantage of the releasable attachment of the clip 28 on the stirrup 20 is the ability of the clip 28 to be pivoted to permit full engagement of each bar 18 by the edges of ends 42–44. This pivoted movement becomes important when the columnar structure being reinforced is conical or of decreasing or varying dimension from one end to the other as in chimney or smoke stack configurations. In addition, on the job adjustment both longitudinally and rotationally of the clips 28 or stirrups 20 is an extreme advantage.

Thus, the several aforenoted objects and advantages are most effectively attained. Although a single somewhat preferred embodiment of the invention has been disclosed and described in detail herein, it should be understood that this invention is in no sense limited thereby and its scope is to be determined by that of the appended claims.

What is claimed is:

1. A longitudinally extending reinforced concrete structure comprising:

a plurality of longitudinal reinforcing bars and transverse stirrups connected with each other comprising a reinforcing network, the stirrups being formed from reinforcing bars, having ribs and deformations on the outer surface thereof;

said stirrups having a plurality of releasably anchored and longitudinally and rotationally shiftable clips engaging said reinforcing bars and locating them in a desired pattern, the clips comprising spring steel bent into a U-shaped configuration with the arms thereof further bent inwardly and toward each other forming hooks for securely holding reinforcing bars within the clips, each clip having holes in the arms thereof and a base from which the arms extend with a concavity in the base, the clip having three point contact with the stirrup with the stirrup engaging with the concavity and the edge of each hole; and a plurality of legs protruding outwardly from the stirrup member for supporting and centering the reinforcing network in formwork for forming the structure.

2. The invention according to claim 1, wherein the arms are divergent from the base and manually shiftable towards one another to permit longitudinal shifting of the clip on the stirrup.

3. The invention according to claim 1, wherein non-rusting caps are disposed on the ends of the legs for supporting the reinforcing frame.

4. A bent spring steel clip for releasable anchoring on a stirrup for engaging longitudinal reinforcing bars and locating them in a desired pattern within a concrete reinforcing network, the clip comprising a base having a concavity, a pair of arms diverging outwardly from the base, each arm having a hole through which the stirrup is adapted to extend, the arms having ends bent inwardly toward one another forming hooks for biting into and securely holding a longitudinaly reinforcing bar within the clip, the clip adapted to have three point engagement with the associated stirrup by the concavity, and edges of the holes.

5. The invention according to claim 4, wherein the arms are manually shiftable towards on another to permit longitudinal shifting of the clip on the stirrup.

* * * * *